US007052086B1

(12) United States Patent
Treytiak

(10) Patent No.: US 7,052,086 B1
(45) Date of Patent: May 30, 2006

(54) SEAT COVER WITH INTEGRAL STORAGE POUCH

(76) Inventor: William Treytiak, 71 Lakeview Cove, Winnipeg, Manitoba (CA) R3X 2B1

( * ) Notice: Subject to any disclaimer, the term of this patent is extended or adjusted under 35 U.S.C. 154(b) by 0 days.

(21) Appl. No.: 11/040,093

(22) Filed: Jan. 24, 2005

(51) Int. Cl.
*A47C 27/00* (2006.01)

(52) U.S. Cl. ..... 297/229; 297/188.2; 297/288.11

(58) Field of Classification Search ..... 297/228.11, 297/229, 188.2, 219.1
See application file for complete search history.

(56) References Cited

U.S. PATENT DOCUMENTS 3,295,887 A * 1/1967 Bacon ..... 297/188.2
4,955,666 A * 9/1990 Baker ..... 297/182
6,030,034 A * 2/2000 Plohetski ..... 297/188.06
6,149,229 A * 11/2000 Dillon et al. ..... 297/188.2
6,676,209 B1 * 1/2004 Szabo et al. ..... 297/219.1

* cited by examiner

*Primary Examiner*—Anthony D. Barfield
(74) *Attorney, Agent, or Firm*—Adrian D. Battison; Michael R. Williams; Ryan W. Dupuis

(57) ABSTRACT

A combination of a seat and a seat cover therefor where the seat has a seat bottom with a bottom panel and a seat cover for covering the seat which includes a fabric pouch with a flap attached to the rear sheet and arranged to extend over the open top for fastening to the front sheet. The fabric pouch has a fastening strip along the edge by which the pouch is fastened to the bottom panel of the seat bottom so that the pouch hangs down from a rear edge of the seat bottom with the open top accessible below the seat. A seat cover portion is shaped and arranged to engage over the seat and is fastened to the pouch such that it can be stored within the pouch and pulled out from the open top of the pouch to cover the seat while the pouch remains attached to the seat by the fastening portion.

18 Claims, 6 Drawing Sheets

SEAT COVER WITH INTEGRAL STORAGE POUCH

This invention relates to a seat cover which can be used to cover an exposed seat for example of a boat which includes a storage container by which the seat cover can be maintained in storage at a suitable and readily available location.

BACKGROUND OF THE INVENTION

Seat covers are readily available for covering a seat in an exterior situation such as the seat of a boat so that when it is out of use the seat is properly covered and thus protected against damage. However the seat cover is often difficult to store and thus may not be available when required or may be misplaced or may require other storage locations which are not available in the location concerned.

SUMMARY OF THE INVENTION

It is one object of the invention to provide an improved seat cover for a seat.

According to one aspect of the invention there is provided a seat cover comprising:

a fabric pouch formed of a front sheet and a rear sheet stitched to form a closed bottom and sides with an open top;

the fabric pouch including a flap attached to the rear sheet and arranged to extend over the open top for fastening to the front sheet;

the fabric pouch including a fastening portion by which the pouch can be fastened to a seat bottom of a seat to be covered so that the pouch hangs down from the seat bottom with the open top accessible below the seat;

and a seat cover portion shaped and arranged to engage over the seat to be covered;

the seat cover portion being fastened to the pouch such that it can be stored within the pouch and pulled out from the open top of the pouch to cover the seat while the pouch remains attached to the seat by the fastening portion.

Preferably the seat cover portion includes an elastic strap or shock cord or pull cord around an outside edge thereof.

Preferably the seat cover portion is fastened to the pouch underneath the flap such that the flap is contained within the seat cover when the seat cover portion is engaged over the seat.

Preferably the seat cover portion is fastened to the rear sheet underneath the flap.

Preferably the fastening portion comprises a strip along a rear edge of the rear sheet for fastening along an edge of the seat bottom.

Preferably the fastening strip includes a plurality of grommets for screw fastening through the grommets onto the seat bottom.

Preferably the pouch includes at least one drainage hole adjacent a bottom edge thereof. A single drainage hole can be used where the bottom edge is inclined from each side toward a center where the drainage hole is located. Alternatively more than one drainage hole may be employed.

Preferably the seat cover portion includes air flow openings adjacent side edges thereof.

Preferably the airflow openings include grommets with perforated screen covers.

According to a second aspect of the invention there is provided a combination of a seat and a seat cover therefor comprising:

a seat having a seat bottom and a seat back attached to the seat bottom at a rear thereof, the seat bottom having a bottom panel and a cushion mounted on the bottom panel;

and a seat cover for covering the seat including:

a fabric pouch formed of a front sheet and a rear sheet stitched to form a closed bottom and sides with an open top;

the fabric pouch including a flap attached to the rear sheet and arranged to extend over the open top for fastening to the front sheet;

the fabric pouch including a fastening portion by which the pouch is fastened to the bottom panel of the seat bottom so that the pouch hangs down from a rear edge of the seat bottom with the open top accessible below the seat;

and a seat cover portion shaped and arranged to engage over the seat;

the seat cover portion being fastened to the pouch such that it can be stored within the pouch and pulled out from the open top of the pouch to cover the seat while the pouch remains attached to the seat by the fastening portion.

Preferably the pouch is slightly narrower than the width of the cover such that it is contained within the width of the rear of the seat.

The seat may have a fold down back or may be of a rigid type with the cover shaped and arranged as required to cover either the folded down back on the seat base or the upstanding back and seat.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 5:
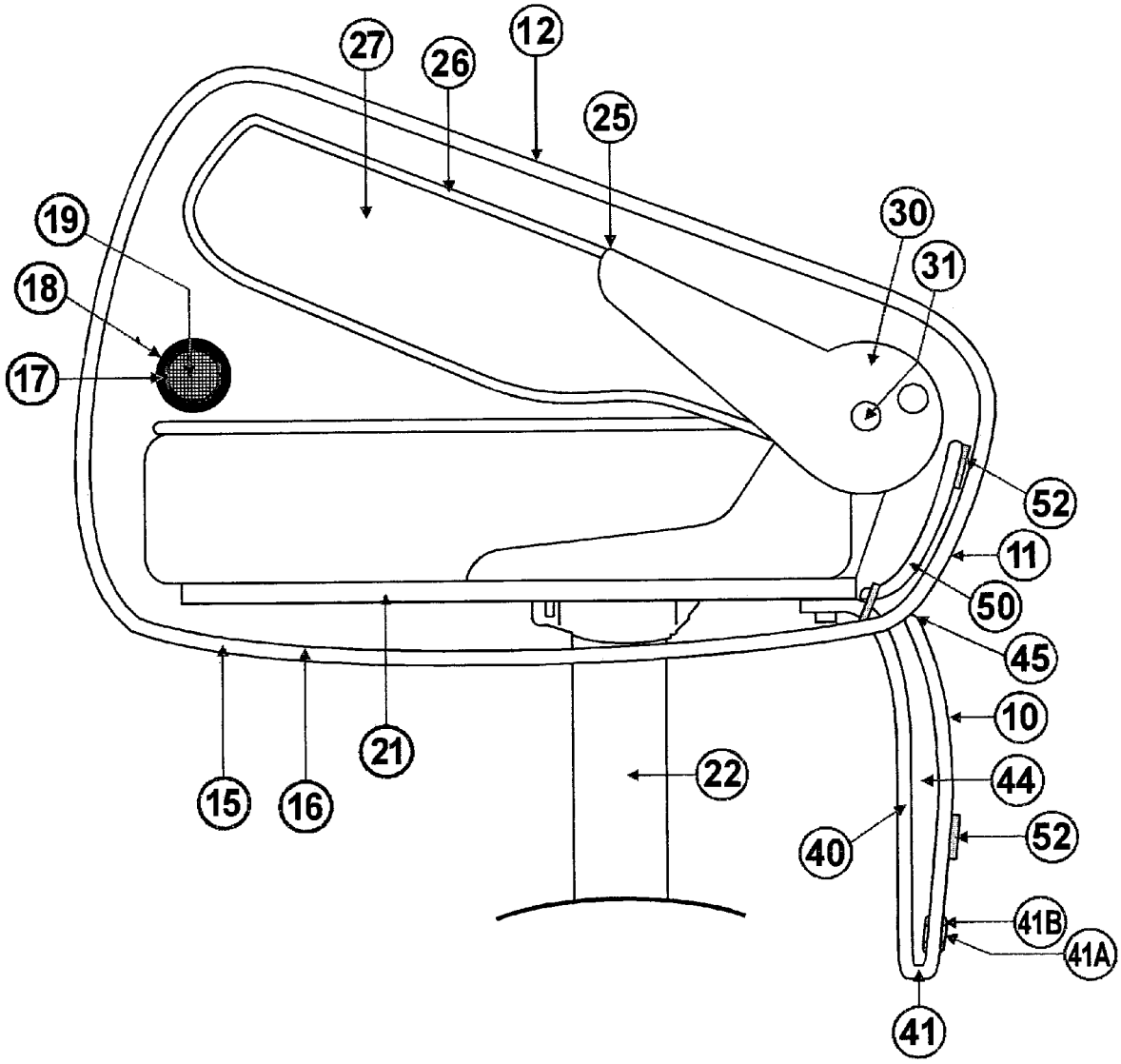
FIG. 5 is a cross sectional view of the seat cover in the deployed position shown in FIG. 4.

The seat cover construction includes a pouch 10 and a seat cover portion 11. The seat cover portion is shaped and arranged so that it wraps over the seat when in the folded condition shown in FIG. 5 with a main upper part 12 and depending sides 13 of the cover portion extending downwardly to a bottom edge 15 at which is located a shock cord, elastic strap or pull cord 16 which pulls the bottom edge inwardly underneath the seat to hold the cover in place. The cord is preferably stitched into a sleeve at the edge, or a strap may be stitched onto the edge. The sides 13 of the cover include ventilation openings 17 in the form of a grommet 18 having a central opening 19 covered by a mesh screen so as to allow penetration of air while venting the penetration of other materials.

The seat includes a seat base 20 with a bottom panel 21 carried on a pedestal 22 and a seat cushion 23 mounted on the bottom panel. A seat back 25 includes a rear panel 26 and a back cushion 27. The rear panel 25 is fastened to the base panel 21 by a pivot mounting 30 including a pivot pin 31 allowing the back to fold downwardly into a flattened condition on top of the seat bottom.

Figure 1:
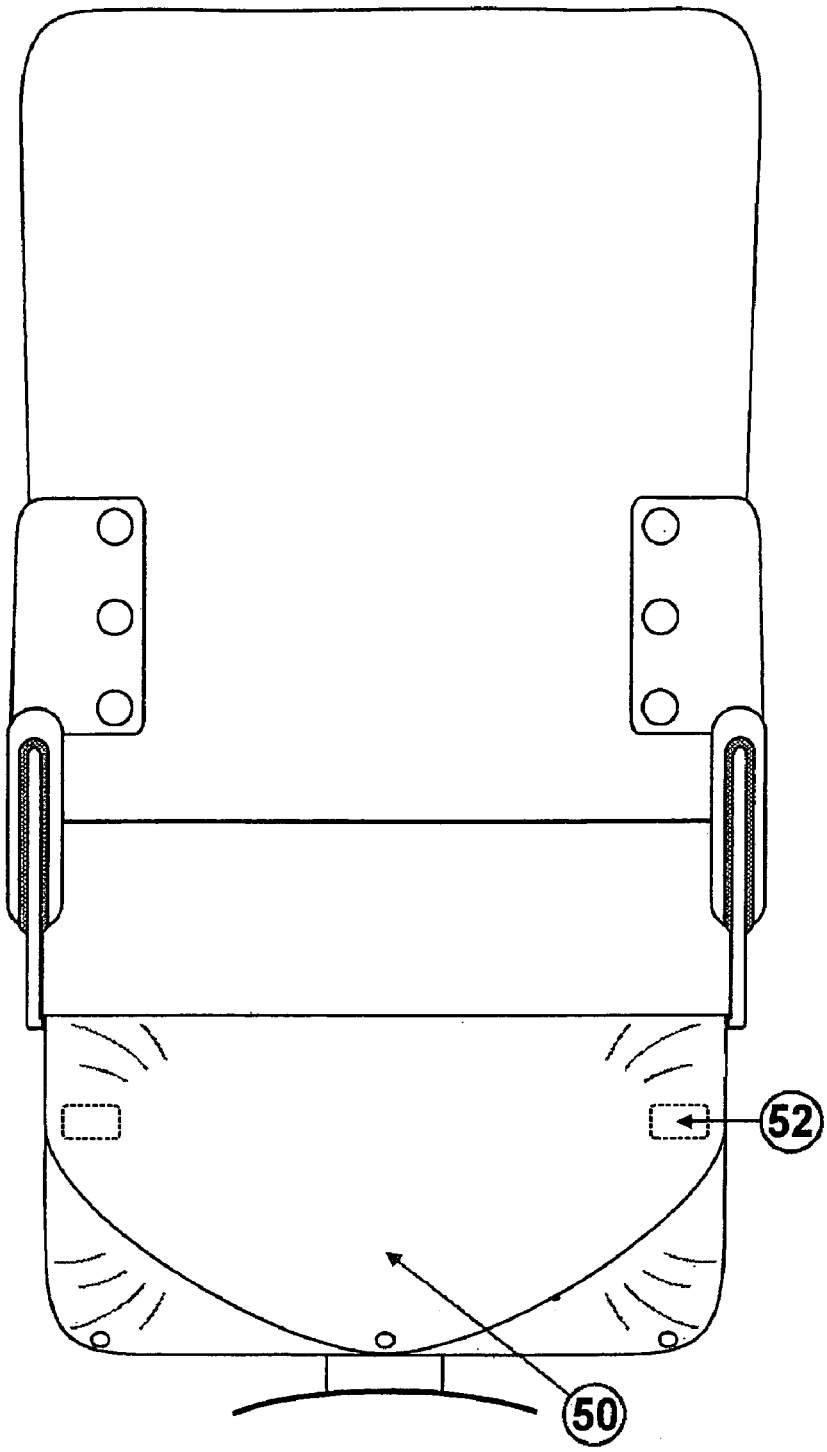
FIG. 1 is a rear elevational view of a seat according to the present invention including a cover in a pouch attached thereto.
Figure 2:
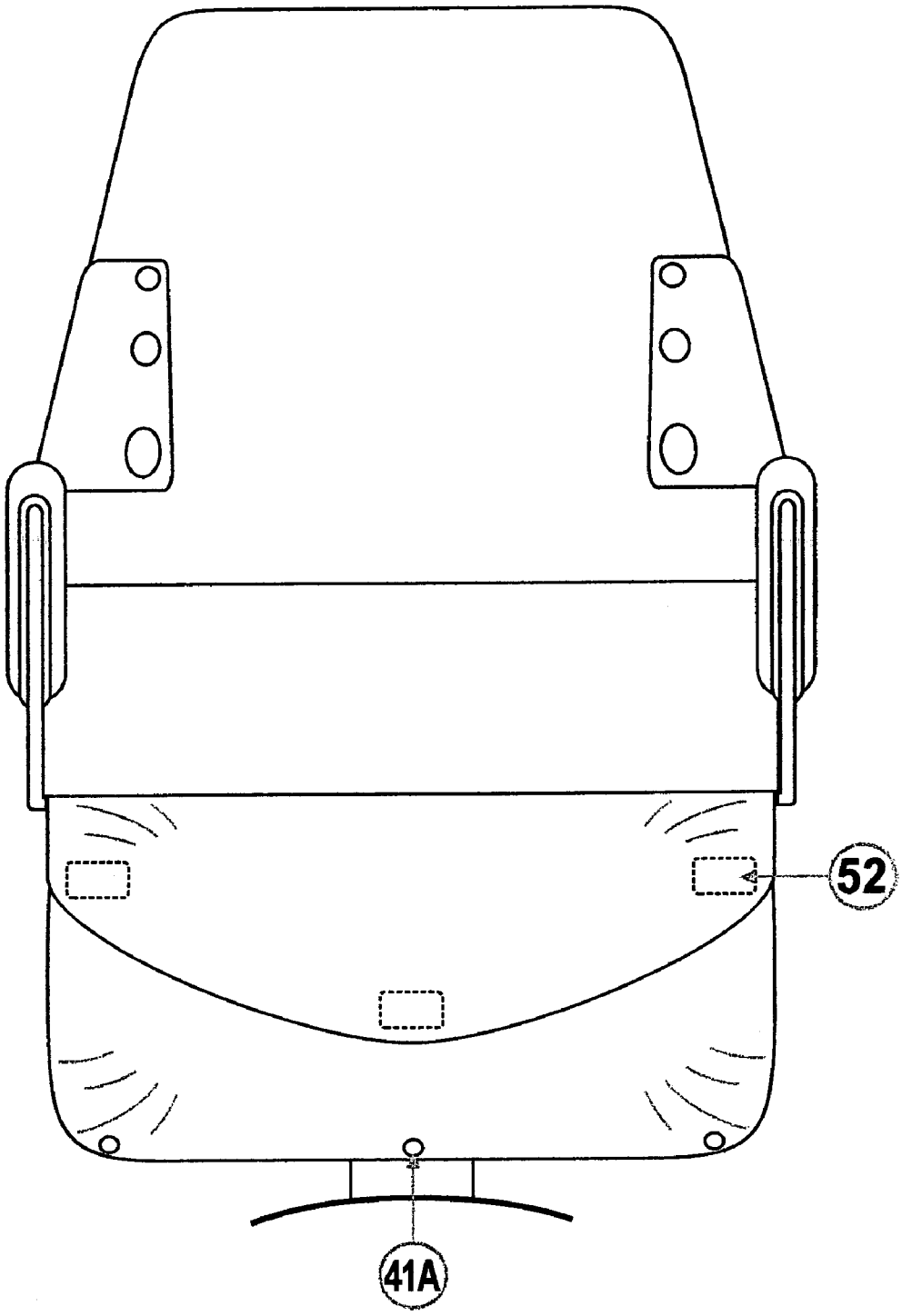
FIG. 2 is a rear elevational view of the seat and pouch with the seat in a folded condition of the backrest.
Figure 3:
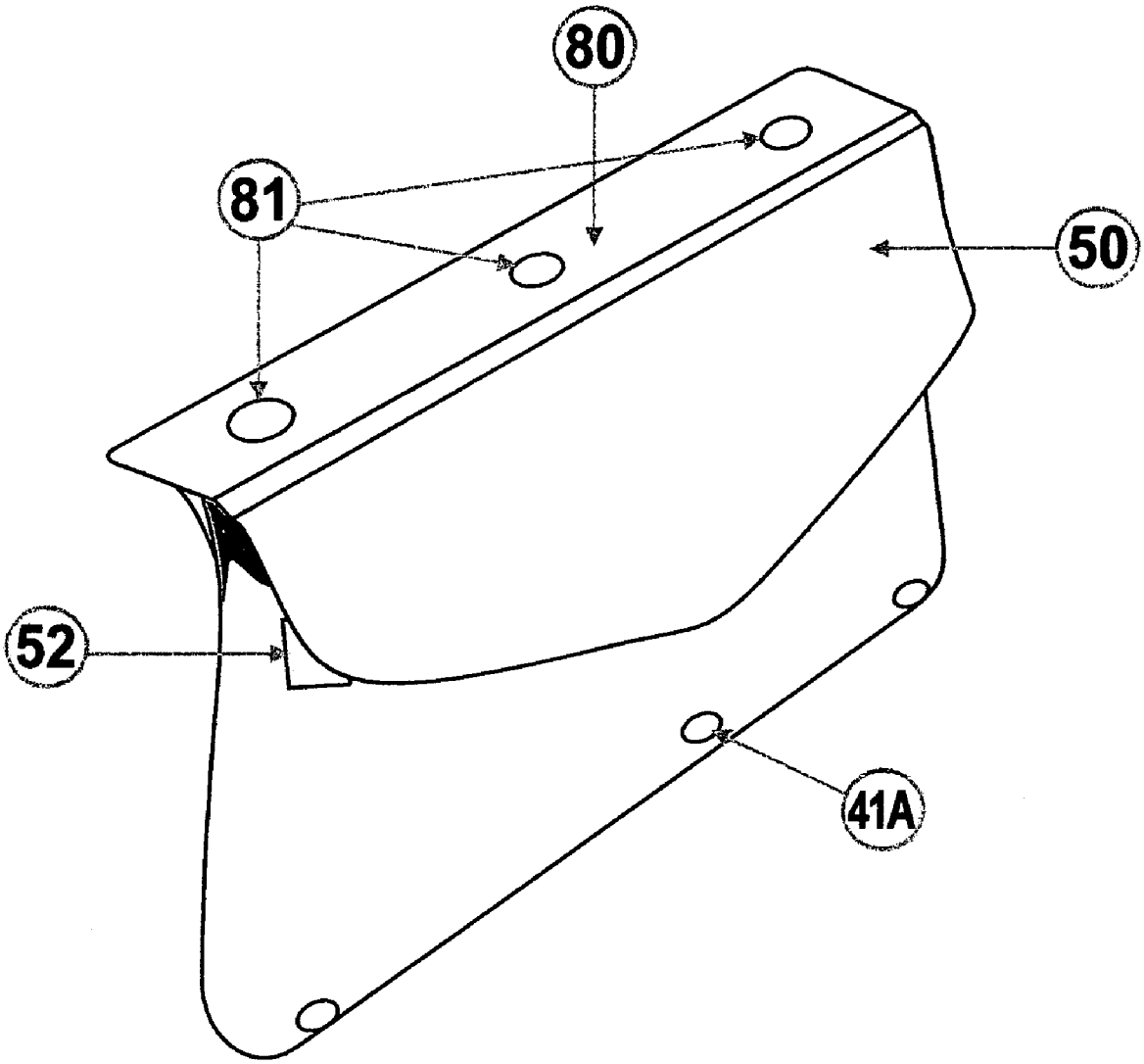
FIG. 3 is an isometric view of the seat cover contained within the pouch.
Figure 4:
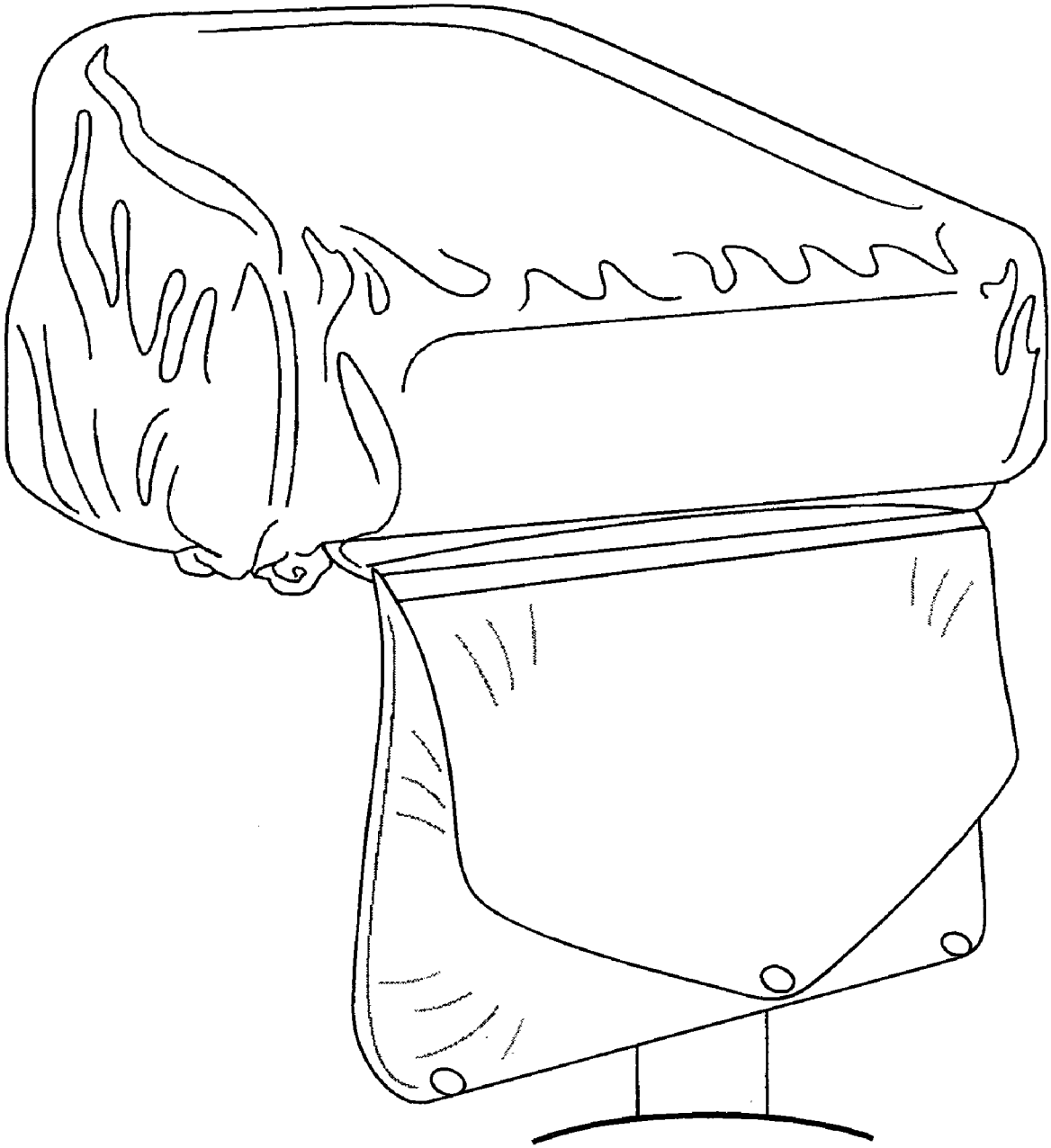
FIG. 4 is an isometric view of the seat cover applied over the seat in the position of FIG. 2.

The pouch 10 is formed from a fabric layer defining a rear wall 40, bottom edge 41 at which the fabric is folded or stitched to define a front wall 42 which extends parallel to the rear wall 40. The front and rear walls are stitched along the sides 43 so that the connection at the bottom and the sides forms a container with a open interior 44 accessible through an open top 45 at the top of the front wall 42. at the bottom edge is provided one or more drainage openings 41A surrounded by a conventional grommet 41B. In the embodiment of FIG. 2, where the bottom edge is inclined downwardly and inwardly to a bottom apex, there is one such drainage opening. In the embodiment of FIG. 1 there are three drainage openings across the bottom.

A flap 50 is stitched onto the rear wall 40 just above the front edge 45 so that it can fold over the open top and cover the open top while being fastened to the front wall 42 by hook and loop fasteners 52. In the embodiment shown in FIG. 1, there are two spaced fastening elements 52 each at a respective side of the flap 50. In FIG. 2, the flap 50 has a bottom edge which is inclined downwardly and inwardly from the side edges to a central apex so that a single central fastener can be used. Thus the bottom edge follows the shape of the bottom edge of the pouch to provide an attractive appearance.

As shown in FIGS. 1 and 2, the width of the pouch is slightly less than the width of the base of the chair so that the strip of the pouch which fastens to the base leaves a short part of the chair on each side to provide an attractive appearance. The cover is thus wider than the pouch and must be folded or compressed into the pouch.

Figure 6:
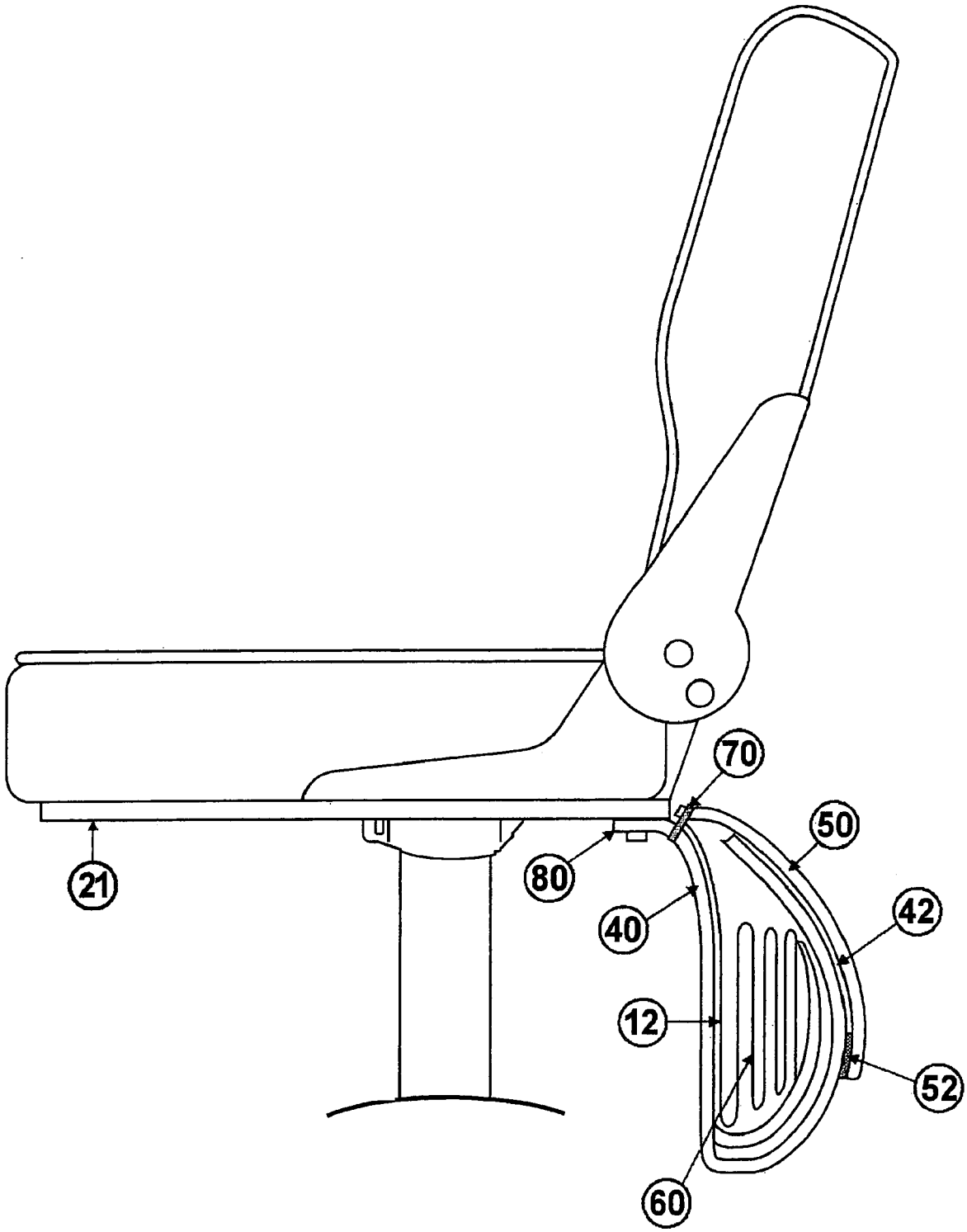
FIG. 6 is a cross sectional view showing the seat cover in the stored position.

The cover portion is stitched also to the rear wall just above the opening 45 and preferably at the same location as the flap so that a forward edge of the cover is fastened to the pouch and is permanently attached to the pouch. The cover can thus be moved from the deployed position shown in FIG. 5 into a folded position shown at 60 where the cover is folded onto itself back and forth by suitable folding action so that it is sufficiently small to enter the opening of the pouch to be contained wholly within the pouch and covered by the flap 50. Within the pouch as shown in FIG. 6, the cover includes the main wall 12 which is stitched to the rear wall 40 at the stitch line 70 which also stitches the flap 50. Along the rear wall 40 is provided a fastening flap or edge strip 80 with a plurality of punched holes 81 surrounded by grommets in conventional manner so as to form a series of holes along the strip 80 by which the strip can be screw fastened to the rear edge of the bottom panel 21 of the seat bottom. Thus the pouch hangs down at the rear of the seat bottom underneath the seat back and forms an attractive appearance at the back and bottom of the seat which is fully enclosed thus simply providing the appearance of a pouch or container depending from the rear of the seat. When required, however, the seat cover can be immediately deployed from the pouch, pulled out from its folded condition and wrapped over the seat with the seat in the folded condition.

Since various modifications can be made in my invention as herein above described, and many apparently widely different embodiments of same made within the spirit and scope of the Claims without department from such spirit and scope, it is intended that all matter contained in the accompanying specification shall be interpreted as illustrative only and not in a limiting sense.

The invention claimed is:

1. A seat cover comprising:

a fabric pouch formed of a front sheet and a rear sheet stitched to form a closed bottom and sides with an open top;

the fabric pouch including a flap attached to the rear sheet and arranged to extend over the open top for fastening to the front sheet;

the fabric pouch including a fastening portion by which the pouch can be fastened to a seat bottom of a seat to be covered so that the pouch hangs down from the seat bottom with the open top accessible below the seat;

and a seat cover portion shaped and arranged to engage over the seat to be covered;

the seat cover portion being fastened to the pouch such that it can be stored within the pouch and pulled out from the open top of the pouch to cover the seat while the pouch remains attached to the seat by the fastening portion.

2. The seat cover according to claim 1 wherein the seat cover portion includes an elastic strap or shock cord or pull cord around an outside edge thereof.

3. The seat cover according to claim 1 wherein the seat cover portion is fastened to the pouch underneath the flap such that the flap is contained within the seat cover when the seat cover portion is engaged over the seat.

4. The seat cover according to claim 1 wherein the seat cover portion is fastened to the rear sheet underneath the flap.

5. The seat cover according to claim 1 wherein the fastening portion comprises a fastening strip along a rear edge of the rear sheet for fastening along an edge of the seat bottom.

6. The seat cover according to claim 5 wherein the fastening strip includes a plurality of grommets for screw fastening through the grommets onto the seat bottom.

7. The seat cover according to claim 1 wherein the pouch includes a plurality of drainage holes adjacent a bottom edge thereof.

8. The seat cover according to claim 1 wherein the seat cover portion includes air flow openings adjacent side edges thereof.

9. The seat cover according to claim 8 wherein the airflow openings include grommets with perforated screen covers.

10. A combination of a seat and a seat cover therefor comprising:

a seat having a seat bottom and a seat back attached to the seat bottom at a rear thereof, the seat bottom having a bottom panel and a cushion mounted on the bottom panel;

and a seat cover for covering the seat including:

a fabric pouch formed of a front sheet and a rear sheet stitched to form a closed bottom and sides with an open top;

the fabric pouch including a flap attached to the rear sheet and arranged to extend over the open top for fastening to the front sheet;

the fabric pouch including a fastening portion by which the pouch is fastened to the bottom panel of the seat bottom so that the pouch hangs down from a rear edge of the seat bottom with the open top accessible below the seat;

and a seat cover portion shaped and arranged to engage over the seat;

the seat cover portion being fastened to the pouch such that it can be stored within the pouch and pulled out from the open top of the pouch to cover the seat while the pouch remains attached to the seat by the fastening portion.

11. The combination according to claim 10 wherein the seat cover portion includes an elastic strap or shock cord or pull cord around an outside edge thereof.

12. The combination according to claim 10 wherein the seat cover portion is fastened to the pouch underneath the flap such that the flap is contained within the seat cover when the seat cover portion is engaged over the seat.

13. The combination according to claim 10 wherein the seat cover portion is fastened to the rear sheet underneath the flap.

14. The combination according to claim 10 wherein the fastening portion comprises a fastening strip along a rear edge of the rear sheet.

15. The combination according to claim 14 wherein the fastening strip includes a plurality of grommets screw fastened onto the seat bottom.

16. The combination according to claim 10 wherein the pouch includes a plurality of drainage holes adjacent a bottom edge thereof.

17. The combination according to claim 10 wherein the seat cover portion includes air flow openings adjacent side edges thereof.

18. The combination according to claim 17 wherein the airflow openings include grommets with perforated screen covers.

* * * * *